US008776748B2

(12) United States Patent
Kobayashi et al.

(10) Patent No.: US 8,776,748 B2
(45) Date of Patent: Jul. 15, 2014

(54) VARIABLE VALVE TIMING CONTROL APPARATUS

(71) Applicant: Aisin Seiki Kabushiki Kaisha, Kariya (JP)

(72) Inventors: Masaki Kobayashi, Okazaki (JP); Kazuo Ueda, Gamagori (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/753,137

(22) Filed: Jan. 29, 2013

(65) Prior Publication Data

US 2013/0233262 A1 Sep. 12, 2013

(30) Foreign Application Priority Data

Mar. 8, 2012 (JP) ..... 2012-052088

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

| | | | |
|---|---|---|---|
| 6,053,139 | A | 4/2000 | Eguchi et al. |
| 2003/0217716 | A1 | 11/2003 | Kusano et al. |
| 2009/0260591 | A1 | 10/2009 | Yamaguchi et al. |
| 2010/0175649 | A1 | 7/2010 | Suzuki et al. |

FOREIGN PATENT DOCUMENTS

| | | | |
|---|---|---|---|
| DE | 199 18 910 | A1 | 11/1999 |
| DE | 10 2009 002 405 | A1 | 10/2009 |
| EP | 2 157 291 | A1 | 2/2010 |
| EP | 2 322 770 | A1 | 5/2011 |
| EP | 2 589 793 | A1 | 5/2013 |
| JP | 2006-322409 | A | 11/2006 |
| JP | 2011-1888 | A | 1/2011 |

OTHER PUBLICATIONS

Extended European Search Report dated Jul. 22, 2013, issued by the European Patent Office in the corresponding European Application No. 13158069.8. (8 pages).

*Primary Examiner* — Zelalem Eshete
(74) *Attorney, Agent, or Firm* — Buchanan Ingersoll & Rooney PC

(57) ABSTRACT

A variable valve timing control apparatus includes a driving side rotating member, a driven side rotating member, a fluid pressure chamber, an advanced angle chamber, a retarded angle chamber, an intermediate lock mechanism including a locking member and a locking hole engaged with the locking member when the locking member comes to protrude, the intermediate lock mechanism being configured to switch between a locked state and an unlocked state, a relative rotational phase of the driven side rotating member relative to the driving side rotating member being restrained at an intermediate phase in the locked state, a valve allowing a fluid to be discharged when electricity is supplied thereto and allowing the fluid to be supplied when supply of electricity is interrupted, and a control portion, wherein the supply of the electricity to the valve is interrupted after a pressure of the fluid starts to decrease.

6 Claims, 4 Drawing Sheets

VARIABLE VALVE TIMING CONTROL APPARATUS

CROSS REFERENCE TO RELATED APPLICATIONS

This application is based on and claims priority under 35 U.S.C. §119 to Japanese Patent Application 2012-052088, filed on Mar. 8, 2012, the entire content of which is incorporated herein by reference.

TECHNICAL FIELD

This disclosure generally relates to a variable valve timing control apparatus.

BACKGROUND DISCUSSION

Recently, a variable valve timing control apparatus that allows opening and closing timing of an intake valve and an exhaust valve to be changed in accordance with an operation condition of an internal combustion engine (which will be hereinafter referred to also as an engine) is practically in use. The above-mentioned variable valve timing control apparatus includes a mechanism, for example, for changing a relative rotational phase of a driven side rotating member relative to a rotation of a driving side rotating member driven to rotate by an operation of the engine, and thereby changing the opening and closing timing of the intake/exhaust valve opened and closed by a rotation of the driven-side rotational member.

Generally, an optimal opening and closing timing of the intake/exhaust valve varies depending on the operation condition of the engine including, for example, a time when the engine starts up and a time when a vehicle runs. Thus, when the engine starts up, the opening and closing timing of the intake/exhaust valve which is optimal for the engine to start up is realized by restraining the relative rotational phase of the driven side rotating member relative to the rotation of the driving side rotating member at a predetermined phase. In addition, a tapping noise, which is generated when a partition portion of a fluid pressure chamber formed by the driving side rotating member and the driven side rotating member moves within the fluid pressure chamber in a circumferential direction of the rotating members, is restricted from occurring. Consequently, before the engine is stopped, the relative rotational phase needs to be restrained at the predetermined phase.

Among lock mechanisms for restraining the relative rotational phase at the predetermined phase, a lock mechanism is known, which includes, for example, a locking member and a coil spring providing a biasing force to the locking member which are accommodated in one of the driving side rotational member and the driven side rotational member, and includes a locking hole provided at the other one of the driving side rotational member and the driven side rotational member. According to this lock mechanism, the locking member is biased by the biasing force to protrude so as to engage with the locking hole so that a locked state is established. The locking member is pushed to retract from the locking hole by a pressure, which is higher than the biasing force, of a working fluid (which will be hereinafter referred to also as a working oil) so that an unlocked state is established.

A known control apparatus of the internal combustion engine, which includes the above-described lock mechanism is disclosed in JP2011-1888A (which will be hereinafter referred to as Patent reference 1). The known control apparatus of the internal combustion engine disclosed in Patent reference 1 is provided with a lock mechanism for locking a relative rotational phase of an inner rotor relative to an outer rotor at a predetermined intermediate phase that is positioned between a most retarded angle phase and a most advanced angle phase. During idling, the relative rotational phase is in the most regarded angle phase. In this state, in a case where an ignition switch is turned off, electricity is supplied to an oil switching valve and thus working oil is not supplied to a hydraulic chamber-for-unlocking. After this, an oil control valve is switched so that the relative rotational phase changes in an advanced angle direction. In a case where the relative rotational phase is in the predetermined intermediate phase, a locking key is biased by a biasing force of a spring to engage with the hydraulic chamber-for-unlocking and locked thereat, so that the relative rotational phase of the outer rotor and the inner rotor relative to each other is locked.

It is judged by an intermediate position fixing determination means whether or not the relative rotational phase of the outer rotor and the inner rotor relative to each other is locked. In a case where it is judged that the relative rotational phase is locked, ignition is turned off and the engine stops. At the same time as the ignition is turned off, the supply of electricity to the oil switching valve is stopped.

According to Patent reference 1, an oil pump is operated by rotation of the engine so that the working oil is supplied. Thus, the oil pump supplies the working oil during a period from a time at which a rotation speed of the engine starts to decrease due to the turning off of the ignition until a time at which the engine stops, and therefore hydraulic pressure is generated. The supply of electricity to the oil switching valve has already been stopped at this time, and thus the working oil is supplied from the oil pump to the oil pressure chamber-for-unlocking, so that the hydraulic pressure works on a pressure-receiving surface of the locking key. In a case where the hydraulic pressure working on the pressure-receiving surface exceeds a hydraulic pressure for unlocking, the lock is released. Once the lock is released, the relative rotational phase changes in a direction which allows the working oil to be supplied from the oil control valve or in a direction which generates an average cam torque (generally, a retarded angle direction), and thus the engine may not be started at an optimal opening and closing timing of the intake/exhaust valve.

A need thus exists for a variable valve timing control apparatus which is not susceptible to the drawback mentioned above.

SUMMARY

According to an aspect of this disclosure, a variable valve timing control apparatus includes a driving side rotating member rotating synchronously with a crankshaft of an internal combustion engine, a driven side rotating member rotating synchronously with a cam shaft for valve openings and closures of the internal combustion engine, a fluid pressure chamber formed by the driving side rotating member and the driven side rotating member, an advanced angle chamber and a retarded angle chamber which are formed by a partition portion provided at least one of the driving side rotating member and the driven side rotating member and partitioning the fluid pressure chamber, an intermediate lock mechanism including a locking member which is accommodated in one of the driving side rotating member and the driven side rotating member and is configured to protrude and retract relative to the other one of the driving side rotating member and the driven side rotating member, the intermediate lock mechanism including a locking hole formed at the other one of the driving side rotating member and the driven side rotating member in a manner that the locking hole is engaged with the locking member when the locking member comes to protrude, the intermediate lock mechanism being configured to switch between a locked state and an unlocked state, a relative rotational phase of the driven side rotating member relative to the driving side rotating member being restrained at an intermediate phase between a most retarded angle phase and a most advanced angle phase in the locked state when the locking member comes to protrude and engages with the locking hole, the restraint being released in the unlocked state as the locking member retracts from the locking hole, a valve operating to allow a fluid to be discharged when electricity is supplied to the valve and thus to bring the intermediate lock mechanism to the locked state, the valve operating to allow the fluid to be supplied when supply of electricity to the valve is interrupted and thus to bring the intermediate lock mechanism to the unlocked state, a control portion for controlling supply and discharge of the fluid to the advanced angle chamber and supply and discharge of the fluid to the retarded angle chamber, and an operation of the valve, wherein the supply of electricity to the valve is interrupted after a pressure of the fluid which is received by a pressure-receiving surface of the locking member starts to decrease on the basis of an operation stop command of the internal combustion engine which is outputted from the control portion in a case where the intermediate lock mechanism is in the locked state.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
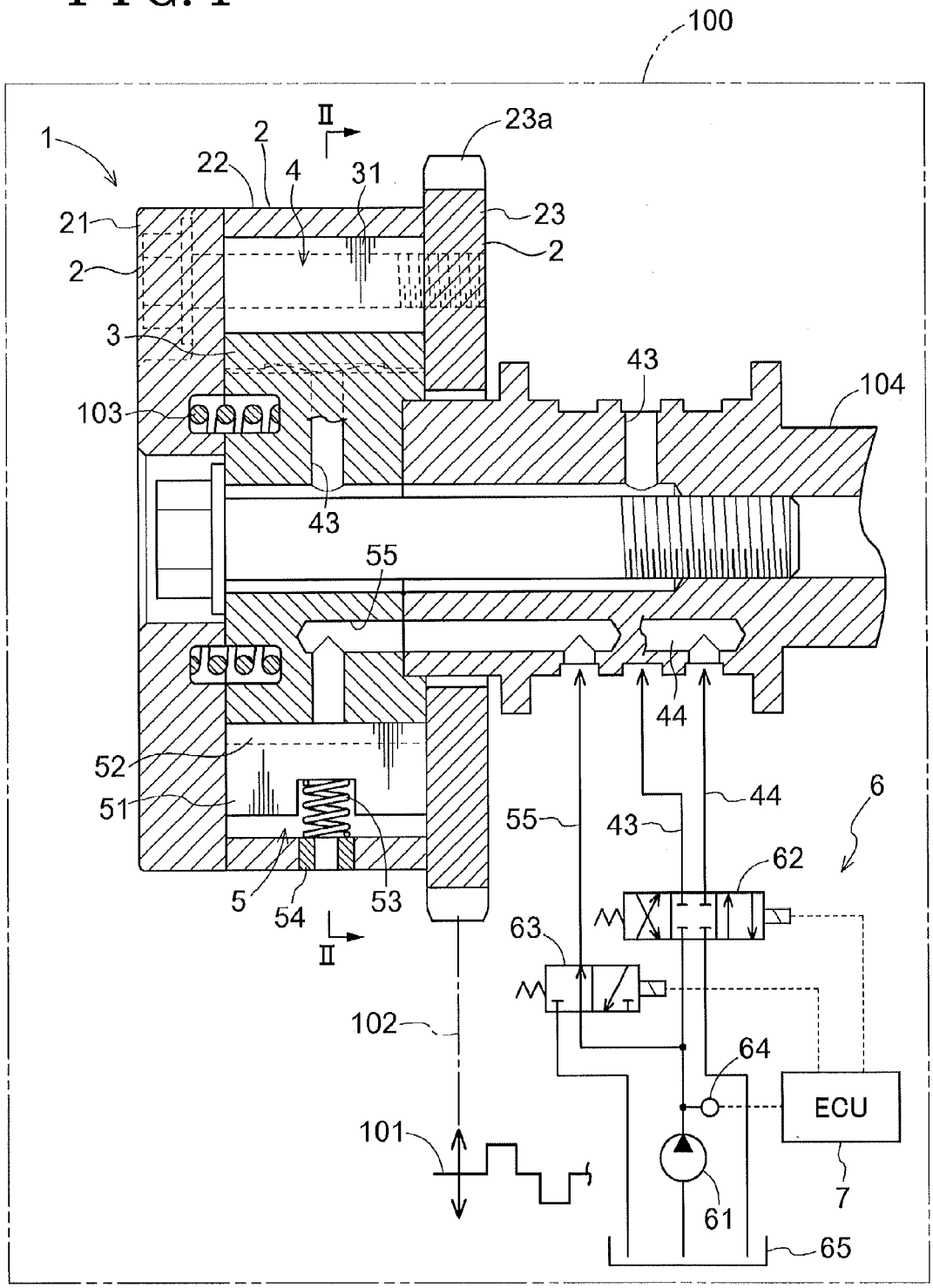
FIG. 1 is a cross-sectional view illustrating an entire structure of a variable valve timing control apparatus according to the embodiments disclosed here.

First, a structure of a variable valve timing control apparatus disclosed here will be explained. A first embodiment disclosed here will be explained in detail with reference to drawings. FIG. 1 is a cross-sectional view illustrating an entire structure of a variable valve timing control apparatus 1 according to the first embodiment. As illustrated in FIG. 1, the variable valve timing control apparatus 1 includes a housing 2 (i.e., a driving side rotating member) and an inner rotor 3 (i.e., a driven side rotating member). The housing 2 rotates synchronously with a crankshaft 101 of an engine 100 (i.e., an internal combustion engine). The inner rotor 3 is arranged inside the housing 2 to be, for example, coaxially with the housing 2 and rotates synchronously with a cam shaft 104. Each of the housing 2 and the inner rotor 3 is made of metal such as, for example, sintered material and/or aluminum alloy. The cam shaft 104 is a rotational shaft of a cam controlling valve openings and closures of an intake valve of the engine 100.

The inner rotor 3 is coupled to an end portion of the cam shaft 104 to be integral therewith. The cam shaft 104 is rotatably coupled to a cylinder head of the engine 100.

The housing 2 is constituted by a front plate 21, a rear plate 23 that is integrally provided with a timing sprocket 23*a* and an outer rotor 22 arranged between the front plate 21 and rear plate 23. The front plate 21, the rear plate 23 and the outer rotor 22 are configured to be integral with one another by means of, for example, fastening of a screw. The inner rotor 3 is rotationally movable relative to the housing 2 within a certain range.

A torsion spring 103 is arranged around the cam shaft 104 across the inner rotor 3 and the front plate 21. The housing 2 and the inner rotor 3 are biased by a biasing force of the torsion spring 103 so that a relative rotational phase of the housing 2 and the inner rotor 3 relative to each other is toward an advanced angle direction. The torsion spring 103, however, may be a torsion spring biasing the housing 2 and the inner rotor 3 towards a retarded angle direction on the basis of the engine 100 at which the variable valve timing control apparatus 1 is provided, or the torsion spring may be eliminated from the structure.

Figure 2:
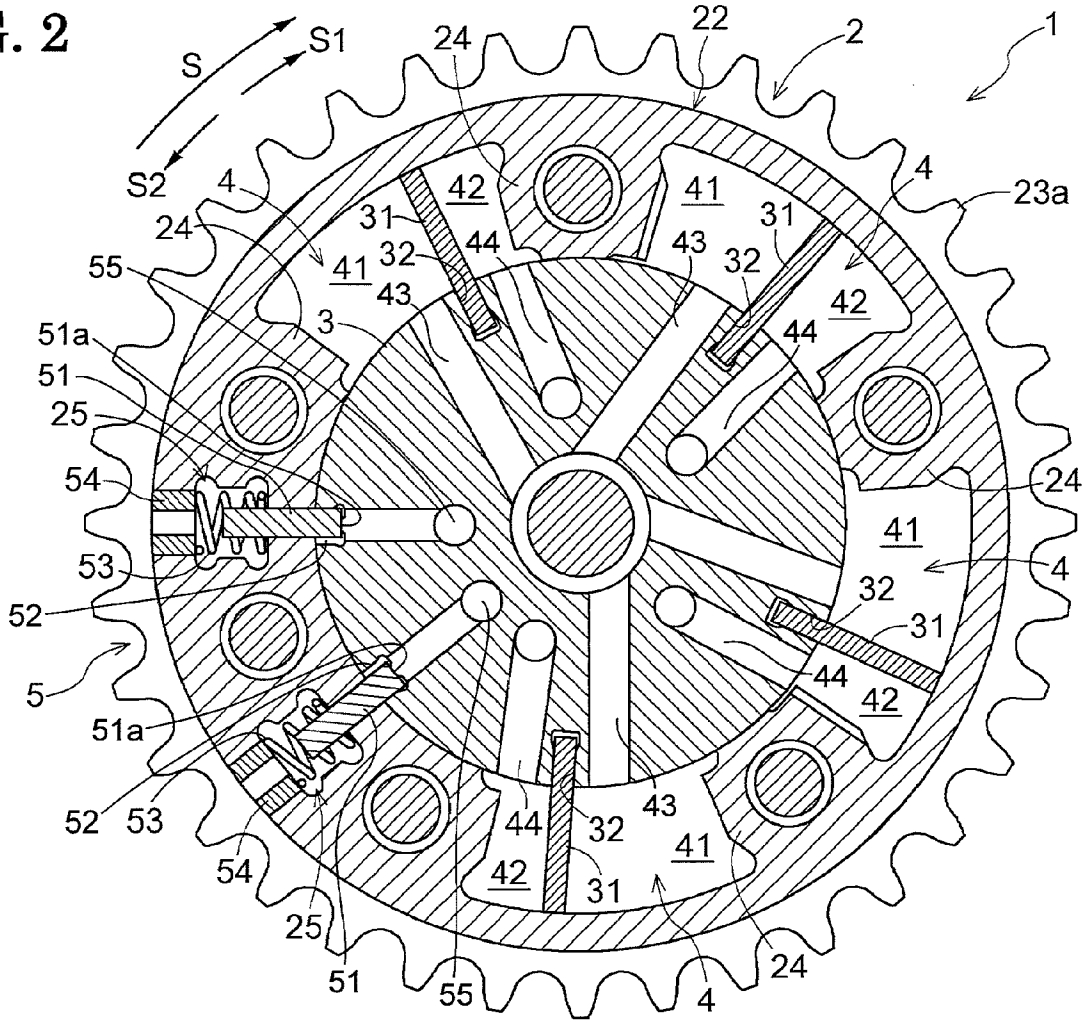
FIG. 2 is a cross-sectional view taken along line II-II in FIG. 1 in a locked state.

As the crankshaft 101 is driven to rotate, a rotational driving force of the crankshaft 101 is transmitted via a power transmission member 102 to the timing sprocket 23*a*, and thus the housing 2 is driven to rotate in a relative rotational direction S illustrated in FIG. 2. As the housing 2 is driven to rotate, the inner rotor 3 is driven to rotate in the relative rotational direction S and the cam shaft 104 is rotated, and thus the cam provided at the cam shaft 104 opens and closes the intake valve of the engine 100.

Figure 3:
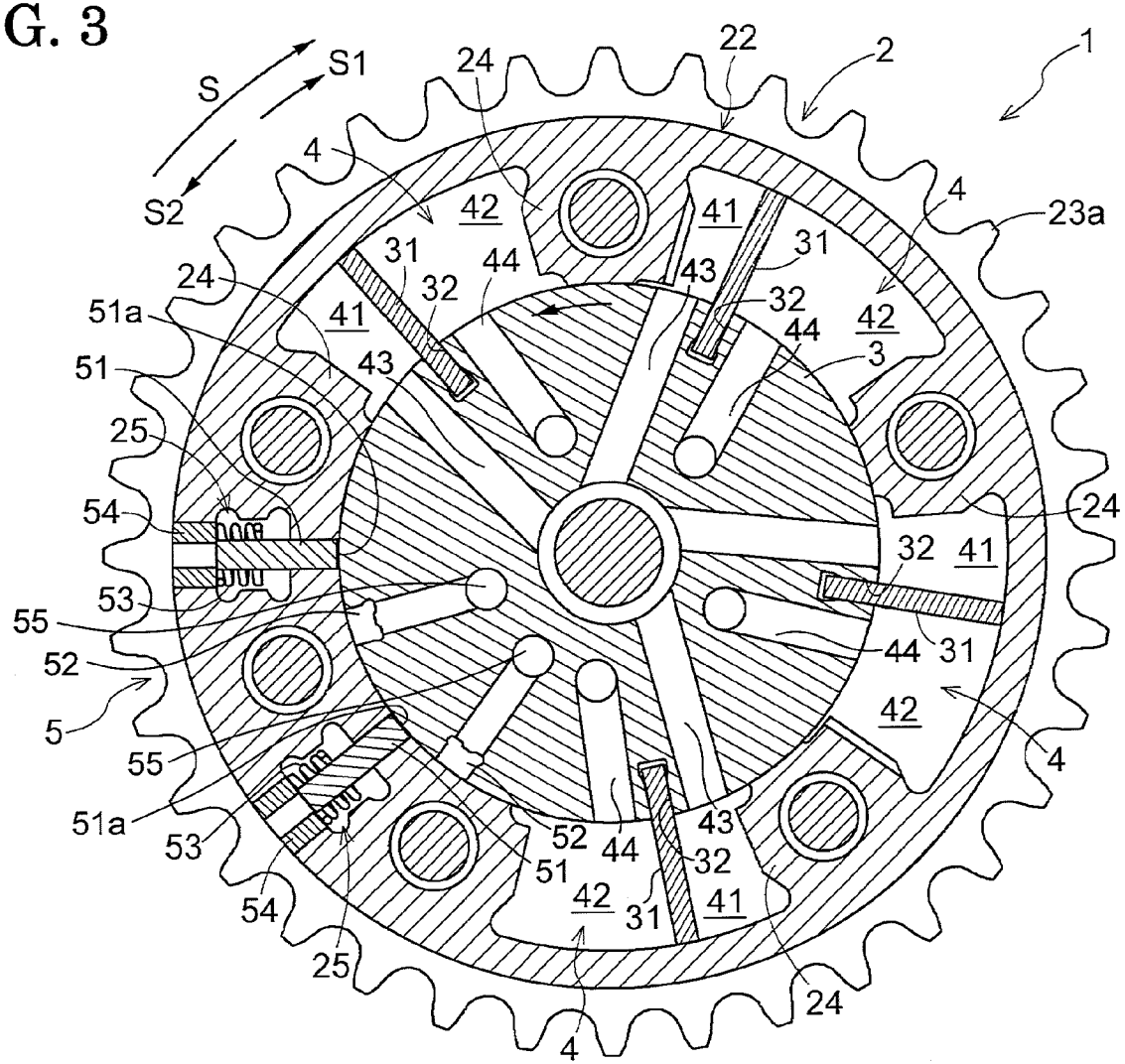
FIG. 3 is a cross-sectional view taken along line II-II in FIG. 1 in an unlocked state.

Each of FIGS. 2 and 3 illustrates a cross-sectional view taken along line II-II in FIG. 1. As illustrated in FIG. 2, the outer rotor 22 is formed with four protruding portions 24 each protruding radially inwardly in a manner that the protruding portions 24 are arranged along the relative rotational direction S and that the adjacent protruding portions 24 are spaced from each other along the relative rotational direction S. Thus, the protruding portions 24 and the inner rotor 3 define a fluid pressure chamber 4. In this embodiment, the fluid pressure chamber 4 is defined at four positions, however, a configuration of the fluid pressure chamber 4 is not limited thereto.

A vane groove 32 is formed at an outer peripheral portion of the inner rotor 3 which faces the corresponding fluid pressure chamber 4. A vane 31 (i.e., a partition portion) is supported at the vane groove 32 in a radial direction so as to be slidable. The vane 31 is biased radially outwardly by a spring provided at an inner diameter side of the vane 31. Each of the fluid pressure chambers 4 is partitioned or divided by the vane 31 into an advanced angle chamber 41 and a retarded angle chamber 42 in the relative rotational direction S. The advanced angle chamber 41 and the retarded angle chamber 42 are respectively connected to an advanced angle passage 43 and to a retarded angle passage 44 both of which are formed at the inner rotor 3. A working fluid (i.e., a fluid) is supplied and discharged through the advanced angle passage 43 and the retarded angle passage 44. The advanced angle passage 43 and the retarded angle passage 44 are connected to a fluid supply and discharge mechanism 6.

The variable valve timing control apparatus 1 is provided with an intermediate lock mechanism 5 for restraining the relative rotational phase of the housing 2 and the inner rotor 3 at an intermediate lock phase (i.e., an intermediate phase) that is between a most advanced angle phase and a most retarded angle phase. The intermediate lock phase refers to a predetermined optimal phase that is optimal for the internal combustion engine to start or a phase that is appropriate for reducing exhaust gasses within a range in which the internal combustion engine may start. Configuration of the intermediate lock mechanism 5 will be briefly explained below. As illustrated in FIG. 2, the intermediate lock mechanism 5 is constituted by two portions which are at one of the protruding portions 24 and which are spaced from each other in a circumferential direction of the housing 2. Specifically, the intermediate lock mechanism 5 is constituted by two locking member insertion portions 25, 25 that are provided at the outer rotor 22, locking members 51, 51 which are provided by insertion at the respective locking member insertion portions 25, 25 and which may protrude into and retract from the respective locking member insertion portions 25, 25 in the radial direction, locking holes 52, 52 that are provided at the inner rotor 3 and may engage with the respective locking members 51, 51, biasing members 53, 53 including, for example, coil springs each supplying a biasing force to the locking members 51, 51 so that each of the locking members 51, 51 protrudes radially inwardly, and stoppers 54, 54 holding the respective biasing members 53, 53 in a compressed state. Each of the locking members 51, 51 is formed in a plate-shape in this embodiment, however, the locking member 51 may be formed in an appropriate shape and configuration, including, for example, a pin-shape instead of the plate-shape.

The locking holes 52, 52 are in fluid communication with respective unlocking passages 55, 55. Supply and discharge of the working fluid is performed through the unlocking passages 55, 55. The unlocking passages 55, 55 are connected to the fluid supply and discharge mechanism 6.

In a state where the working fluid is discharged out of the locking holes 52, 52, in a case where the locking members 51, 51 and the respective locking holes 52, 52 come to face each other due to relative rotation of the housing 2 relative to the inner rotor 3, the locking members 51, 51 are biased by the biasing force of the biasing members 53, 53 to protrude radially inwardly so as to engage with the respective locking holes 52, 52. Thus, a locked state is established, where the relative rotational phase of the housing 2 and the inner rotor 3 relative to each other is restrained (which will be hereinafter referred to also as "locked") at the intermediate lock phase. FIG. 2 illustrates a cross-sectional view taken along line II-II in FIG. 1 in the locked state.

In the locked state, in a case where the working fluid is supplied via the unlocking passages 55, 55 to the locking holes 52, 52, an end surface of each of the locking members 51, 51, which serves as a pressure-receiving surface 51*a*, receives a fluid pressure of the working fluid. In a case where the fluid pressure received by the pressure-receiving surfaces 51*a*, 51*a* exceed the biasing force of the biasing members 53, 53, the locking members 51, 51 retract from the respective locking holes 52, 52, and thus the restraint is released (which will be hereinafter referred to as "the locked state is released"). Thus, an unlocked state is established, where the relative rotational phase of the housing 2 and the inner rotor 3 is changeable. FIG. 3 illustrates a cross-sectional view taken along line II-II in FIG. 1 in the unlocked state.

Configuration of the fluid supply and discharge mechanism 6 will be briefly explained below. As illustrated in FIG. 1, the fluid supply and discharge mechanism 6 is provided with an oil pump 61 driven by the engine 100 to supply the working fluid, an OCV (an oil control valve) 62 for controlling supply and discharge of the working fluid relative to the advanced angle passage 43 and the retarded angle passage 44, an OSV (an oil switching valve) 63 for switching between supply and discharge of the working fluid relative to the intermediate lock mechanism 5, a fluid pressure sensor 64 for detecting pressure of the working fluid discharged from the oil pump 61, and an oil pan 65 at which the working fluid is stored. The OSV 63 serves as a valve.

The oil pump 61 is a mechanical pump and is actuated by the rotational driving force of the crankshaft 101 which is transmitted to the oil pump 61. The oil pump 61 suctions the working fluid stored at the oil pan 65 and discharges the suctioned working fluid toward the OCV 62 and the OSV 63 which are positioned at a downstream side relative to the oil pump 61.

The OCV 62 is provided between the oil pump 61, and the advanced angle chamber 41 and the retarded angle chamber 42. The OCV 62 operates by changing a position of a spool valve provided inside the OCV 62 in accordance with control performed by an ECU 7 (an engine control unit), which serves as a control portion, on an amount of electricity to be supplied. Specifically, the OCV 62 performs three kinds of operations, which respectively corresponds to an advanced angle control under which the working fluid is supplied to the advanced angle chamber 41 and is discharged out of the retarded angle chamber 42, a retarded angle control under which the working fluid is discharged out of the advanced angle chamber 41 and is supplied to the retarded angle chamber 42, and a control under which supply and discharge of the working fluid relative to the advanced angle chamber 41 and the retarded angle chamber 42 is interrupted.

In the first embodiment, when the amount of electricity supplied to the OCV 62 is at maximum, a working fluid pathway that enables the advanced angle control to be conducted is formed and the working fluid is supplied to the advanced angle chamber 41 so that a capacity of the advanced angle chamber 41 increases. Thus, the relative rotational phase of the inner rotor 3 relative to the outer rotor 22 is displaced in the advanced angle direction (a direction S1). In a case where electrification, that is, the supply of electricity to the OCV 62 is interrupted, an working fluid pathway that enables the retarded angle control to be conducted is formed and the working fluid is supplied to the retarded angle chamber 42 so that a capacity of the retarded angle chamber 42 increases. Thus, the relative rotational phase is displaced in the retarded angle direction (a direction S2).

The OSV 63 is arranged between the oil pump 61 and the locking holes 52, 52, and is arranged in parallel with the OCV 62. The OSV 63 switches between the supply and the discharge of the working fluid by changing a position of a spool valve provided inside the OSV 63 in accordance with control performed by the ECU 7 on the supply and interruption of the supply of electricity. That is, the working fluid is discharged out of the locking holes 52, 52 in a case where the OSV 63 is supplied with electricity and the working fluid is supplied to the locking holes 52, 52 in a case where supply of electricity to the OSV 63 is interrupted. In a state where electricity is supplied to the OSV 63 and thus the working fluid is discharged, in a case where the locking members 51, 51 and the respective locking holes 52, 52 come to face each other, the locked state is established. In a case where the supply of electricity to the OSV 63 in the locked state is interrupted so that the working fluid is supplied to the locking holes 52, 52, if the fluid pressure received by the pressure-receiving surfaces 51*a*, 51*a* of the respective locking members 51, 51 exceeds the biasing force of the biasing members 53, 53, the unlocked state is established. The OSV 63 and the OCV 62 operate independent from each other.

The fluid pressure sensor 64 is arranged at a downstream side relative to a discharging outlet of the oil pump 61 and at an upstream side relative to a branch point at which a passage of the working fluid is branched into the OCV 62 and the OSV 63. The fluid pressure sensor 64 detects a pressure value of the working fluid discharged from the oil pump 61 in real-time and transmits a signal of the pressure value to the ECU 7.

Next, an operation of the variable valve timing control apparatus 1 will be explained. Changes in each parameter will be explained with reference to a timing chart illustrated in FIG. 4, where the operation of the engine 100 is stopped. The operations of the variable valve timing control apparatus when the engine starts up and when the engine is operating are well known, and therefore detailed explanation will be omitted. In the first embodiment, during idling before the operation of the engine 100 stops, the relative rotational phase of the housing 2 and the inner rotor 3 relative to each other is at a most retarded angle position. In this state, in a case where an ignition switch (refer to IGN SW in FIG. 4) of the engine 100 is turned off (a time T1 in FIG. 4), the ECU 7 detects an operation stop signal outputted due to an ignition switch off and performs the control for supplying electricity to the OSV 63 so that the housing 2 and the inner rotor 3 are locked at the intermediate lock phase by the intermediate lock mechanism 5 (refer to OSV DUTY in FIG. 4). Once the OSV 63 is energized, that is, supplied with electricity, the working fluid existing in the locking holes 52, 52 is discharged therefrom via the unlocking passages 55, 55. Even in a case where the ECU 7 detects the operation stop signal, the ignition-off does not take place until the relative rotational phase of the housing 2 and the inner rotor 3 comes to the intermediate lock phase and is locked thereat (a delay control).

Figure 4:
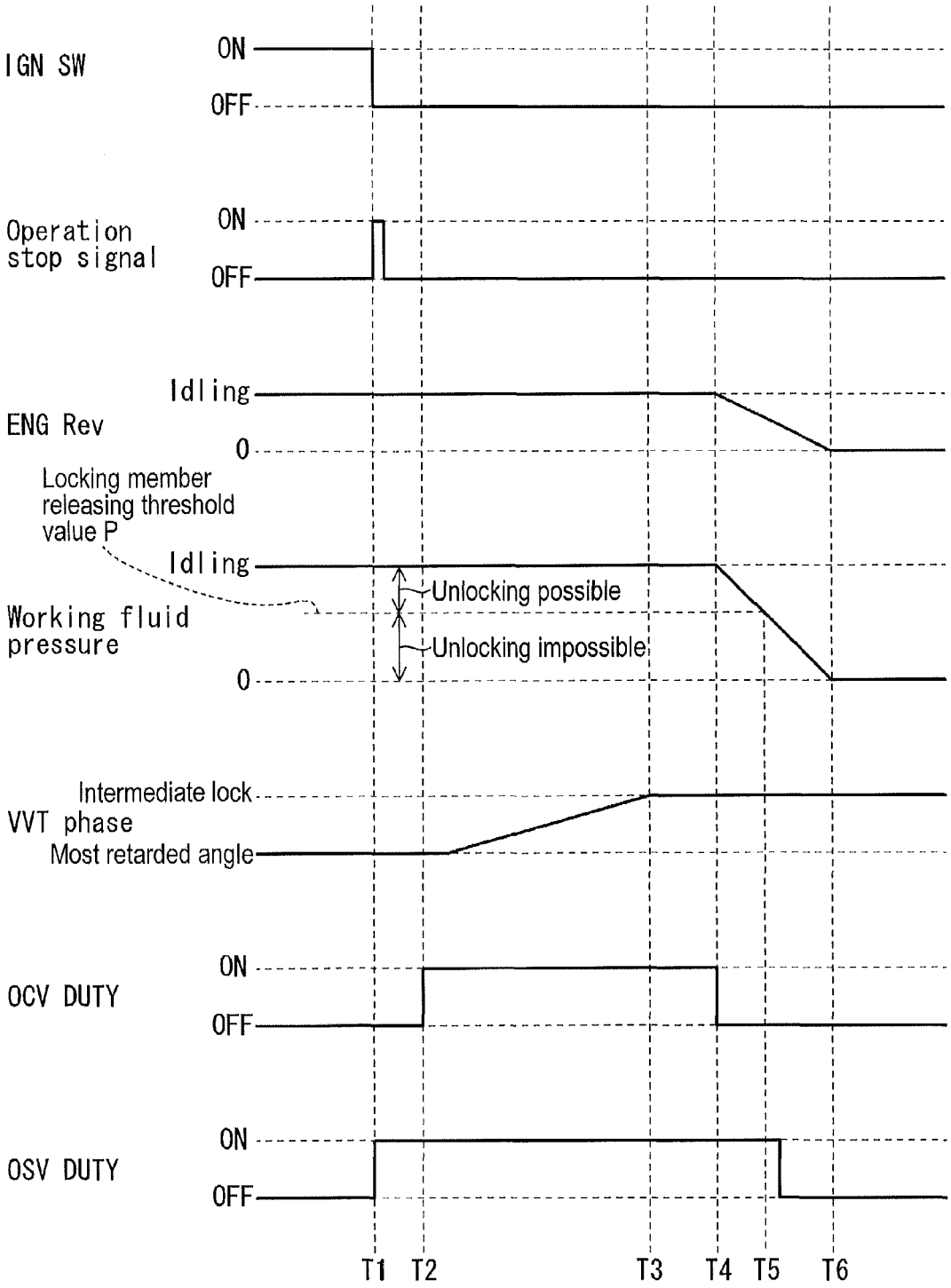
FIG. 4 is a timing chart illustrating changes in each parameter when operation of an internal combustion engine is stopped according to the embodiments disclosed here.

At a time T2 when a predetermined period of time elapsed after the OSV 63 is brought to be energized, the ECU 7 performs the control for maximizing the amount of electricity supplied to the OCV 62 (refer to OCV DUTY in FIG. 4). When the OCV 62 is energized, the working fluid pathway, which enables the advanced angle control to be conducted, is formed, and thus the working fluid is supplied via the advanced angle passage 43 to the advanced angle chamber 41 and the working fluid is discharged out of the retarded angle chamber 42 via the retarded angle passage 44. Accordingly, the relative rotational phase of the inner rotor 3 relative to the housing 2 changes in the advanced angle direction (refer to VVT phase in FIG. 4).

In a case where the inner rotor 3 is driven to rotate so that the relative rotational phase is displaced to the advanced angle direction and when the locking members 51, 51 and the respective locking holes 52, 52 come to face each other, the locking member 51, 51 that are biased by the biasing force of the biasing members 53, 53 protrude radially inwardly so as to engage with the respective locking holes 52, 52. Thus, the relative rotational phase is restrained at the intermediate lock phase, thereby establishing the locked state (a time T3).

Judgment on whether or not the locked state is established is made based on detection signals from a cam angle sensor for detecting a rotational angle of the cam of the intake valve and a crank angle sensor for detecting a rotational angle of the crankshaft 101. In a case where the relative rotational phase of the housing 2 and the inner rotor 3 relative to each other is within a range of a predetermined phase for a predetermined period of time, the ECU 7 judges that the relative rotational phase of the housing 2 and the inner rotor 3 relative to each other is fixed at the intermediate lock phase and that the locked state is established. Until this time point, the engine 100 is in operation, and thus the oil pump 61 is in operation to discharge the working fluid, and therefore the fluid pressure is generated.

Once the ECU 7 judges that the relative rotational phase is locked at the intermediate lock phase, the ECU 7 issues an operation stop command and performs a control for turning off the ignition of the engine 100 (a time T4). Thus, the ignition of the engine 100 is turned off and the engine 100 stops operating at a time T6 (refer to ENG Rev in FIG. 4). At the same time when the ignition is turned off, the energization of the OCV 62, that is, the supply of electricity to the OCV 62 is interrupted.

During a period from the time T4 at which the ignition of the engine 100 is turned off to the time T6 at which the engine 100 stops operating, a rotation speed of the crankshaft 101 of the engine 100 (which will be referred to also as a rotation speed of the engine) decreases from an idling rotational speed down to, eventually, zero. During the period from the time T4 to the time T6, as the rotation speed of the engine decreases, an amount of working fluid discharged from the oil pump 61 decreases, and thus the generated fluid pressure is lowered (refer to a working fluid pressure in FIG. 4). During idling, however, the fluid pressure working on the pressure-receiving surfaces 51*a*, 51*a* of the respective locking members 51, 51 may be sufficiently higher than the biasing force of the biasing members 53, 53, especially when temperature of the working fluid is low, and therefore, the working fluid is supplied to the locking holes 52, 52 if the supply of electricity to the OSV 63 is interrupted at the time T4. As a result, the pressure-receiving surfaces 51*a*, 51*a* of the respective locking members 51, 51 receive the fluid pressure, thereby possibly releasing the locked state.

As described above, the fluid pressure sensor 64 detects the pressure of the working fluid discharged from the oil pump 61, and transmits a pressure signal based on the detected pressure of the working fluid to the ECU 7 in real-time. At an inside of the ECU 7, data of a locking member releasing threshold value P (i.e., a predetermined pressure) which refers to a fluid pressure competing with the biasing force of the biasing members 53, 53 is provided in advance. The ECU 7 compares in real time the pressure of the working fluid which is transmitted from the fluid pressure sensor 64 with the locking member releasing threshold value P of the fluid pressure. In a case where the fluid pressure which is detected by the fluid pressure sensor 64 is equal to or higher than the locking member releasing threshold value P, the ECU 7 controls the OSV 63 so that the supply of electricity to the OSV 63 is continued. In a case where the detected fluid pressure is below, that is, decreased relative to the locking member releasing threshold value P, the ECU 7 controls the OSV 63 so that the supply of electricity to the OSV 63 is interrupted. Thus, at the time T4, the ECU 7 performs the control for continuing the supply of electricity to the OSV 63, and therefore the working fluid is not supplied to the locking holes 52, 52. As a result, the locked state is maintained at the intermediate lock mechanism 5.

When a time T5, at which the fluid pressure detected at the fluid pressure sensor 64 comes to be equal to the locking member releasing threshold value P, elapsed, the ECU 7 performs the control for interrupting the supply of electricity to the OSV 63. At this time point, the oil pump 61 is in operation, and thus the working fluid pressure is generated. In a case where the supply of electricity to the OSV 63 is interrupted, the working fluid is supplied via the unlocking passages 55, 55 to the locking holes 52, 52, and the fluid pressure works on the pressure-receiving surfaces 51*a*, 51*a* of the respective locking members 51, 51. The fluid pressure works, against the biasing force of the biasing members 53, 53, in a direction in which the locking members 51, 51 retract from the respective locking holes 52, 52. However, the fluid pressure is lower than the biasing force, and thus the locking members 51, 51 do not retract from the locking holes 52, 52, and therefore the locked state is maintained. Under the above-described controls, the operation of the engine 100 is stopped in a state where the relative rotational phase of the housing 2 and the inner rotor 3 is maintained at the intermediate lock phase, and therefore the internal combustion engine, that is, the engine 100, is started up at an optimal valve opening and closing timing of the intake/exhaust valve.

The fluid pressure sensor 64 directly and accurately detects the pressure of the working fluid which is received by the pressure-receiving surfaces 51*a*, 51*a* of the respective locking members 51, 51. Thus, in a case where the detected pressure of the working fluid comes to be below the locking member releasing threshold value P during the time at which the rotation speed of the engine starts to decrease until the time at which the engine 100 stops operating, the supply of electricity to the OSV 63 may be interrupted immediately. As a result, the supply of electricity to the OSV 63 may be interrupted in a short period of time after the time T5 elapsed, and thus the intermediate lock mechanism 5 reliably maintains the locked state with the minimum necessary supply of electricity.

In the first embodiment, the OSV 63 (the oil switching valve) has a function for switching between the supply and the discharge of the working fluid relative to the locking hole by switching the supply and the interruption of the supply of electricity, however, the function of the OSV 63 is not limited thereto. The oil switching valve includes a type of valve which has a function for switching the supply and the discharge of the working fluid relative to the advanced angle chamber and to the retarded angle chamber in addition to the function for switching the supply and the discharge of the working fluid relative to the locking hole. The function for switching the supply and the discharge of the working fluid relative to the advanced angle chamber and to the retarded angle chamber operates independently from the function for switching the supply and the discharge of the working fluid relative to the locking hole. In a case where the above-mentioned type of valve, which includes the two functions, is applied, there is no need to use the oil control valve separately.

A second embodiment disclosed here will be explained in detail with reference to the drawings. In the first embodiment, a timing at which the supply of electricity to the OSV 63 is interrupted is determined by means of the fluid pressure sensor 64. However, the timing at which the supply of electricity to the oil switching valve is interrupted may be determined, for example, in the following method even in a case where a vehicle is not provided with the fluid pressure sensor. The crank angle sensor for detecting the rotation speed of the crankshaft and a cooling medium temperature sensor measuring temperature of a cooling medium that flows through the internal combustion engine are always provided at the vehicle. A range of the pressure of the working fluid is obtained or calculated indirectly on the basis of the rotation speed of the crankshaft, and a temperature range of the working fluid at that time is obtained or calculated indirectly on the basis of the temperature of the cooling medium which is detected by the cooling medium temperature sensor. As a negative correlation exists between the pressure of the working fluid and the temperature of the working fluid, the pressure of the working fluid in a narrower range may be estimated on the basis of the rotation speed of the crankshaft and the temperature of the cooling medium.

The estimation is made in the following manner. Data, in real-time, of the rotation speed of the crankshaft and the cooling medium temperature is transmitted to the ECU. By providing a table that associates the rotation speed of the crankshaft with the range of the pressure of the working fluid at the inside of the ECU, the pressure range of the working fluid may be estimated at the ECU in real-time. In a similar manner to the above, by providing a table that associates the temperature of the cooling medium with the temperature range of the working fluid at the inside of the ECU, the temperature range of the working fluid may be estimated at the ECU in real-time. By providing a table that associates the pressure range of the working fluid with the temperature range of the working fluid at the inside of the ECU, the narrower range of the fluid pressure may be estimated at the ECU in real-time.

With the above-described configuration, the fluid pressure is estimated on the vehicle that is not provided with the fluid pressure sensor. Thus, in a case where the estimated fluid pressure comes to be below the locking member releasing threshold value P during the period from the time at which the rotation speed of the crankshaft starts to decrease until the time at which the internal combustion engine stops operating, the supply of electricity to the oil switching valve may be interrupted. As a result, the intermediate lock mechanism reliably maintains the locked state even after the supply of electricity is interrupted, and thus the internal combustion engine is started up at the optimal valve opening and closing timing of the intake/exhaust valve.

In the second embodiment, the ECU is configured to include the three kinds of tables, however, the configuration of the ECU is not limited thereto. The ECU may be configured to include only a table that estimates the fluid pressure from the rotation speed of the crankshaft and the temperature of the cooling medium.

A third embodiment disclosed here will be explained with reference to the drawings. In the first and second embodiments, the ECU determines the timing at which the supply of electricity to the oil control valve is interrupted on the basis of output signals from each sensor. However, it is possible for the ECU to determine the timing at which the supply of electricity to the oil control valve is interrupted without using the sensors. For example, when a sufficient period of time (i.e., a period of time), for example, one second, has elapsed after the ignition of the engine is turned off, the rotation speed of the engine decreases to nearly zero or the engine stops. At this time, the pressure of the working fluid is sufficiently lower than the locking member releasing threshold value P. Thus, by interrupting the supply of electricity to the oil control valve after the above-mentioned period of time elapsed, the intermediate lock mechanism reliably maintains the locked state after the supply of electricity is interrupted. Accordingly, the internal combustion engine is started up at the optimal valve opening and closing timing of the intake/exhaust valve.

With the above-described configuration, there is no need for each of the sensors to perform complicated control, and thus the intermediate lock mechanism may reliably maintain the locked state with an inexpensive configuration.

In the embodiments, the variable valve timing control apparatus 1 is applied at an intake side, however, the application of the apparatus is not limited thereto. The variable valve timing control apparatus 1 may be applied, for example, at an exhaust side.

The aforementioned embodiments may be applied to a variable valve timing control apparatus for controlling a relative rotational phase of the driven side rotating member relative to the driving side rotating member that rotates synchronously with the crankshaft of the internal combustion engine.

According to the embodiments, the variable valve timing control apparatus 1 includes the housing 2 rotating synchronously with the crankshaft 101 of the engine 100, the inner rotor 3 rotating synchronously with the cam shaft 104 for valve openings and closures of the engine 100, the fluid pressure chamber formed by the housing 2 and the inner rotor 3, the advanced angle chamber 41 and the retarded angle chamber 42 which are formed by the vane 31 provided at least one of the housing 2 and the inner rotor 3 and partitioning the fluid pressure chamber 4, the intermediate lock mechanism 5 including the locking member 51 which is accommodated in one of the housing 2 and the inner rotor 3 and is configured to protrude and retract relative to the other one of the housing 2 and the inner rotor 3, the intermediate lock mechanism 5 including the locking hole 52 formed at the other one of the housing 2 and the inner rotor 3 in a manner that the locking hole 52 is engaged with the locking member 51 when the locking member 51 comes to protrude, the intermediate lock mechanism 5 being configured to switch between the locked state and the unlocked state, the relative rotational phase of the inner rotor 3 relative to the housing 2 being restrained at the intermediate lock phase between the most retarded angle phase and the most advanced angle phase in the locked state when the locking member 51 comes to protrude and engages with the locking hole 52, the restraint being released in the unlocked state as the locking member 51 retracts from the locking hole 52, the oil switching valve 63 operating to allow the fluid to be discharged when electricity is supplied to the oil switching valve 63 and thus to bring the intermediate lock mechanism 5 to the locked state, the oil switching valve 63 operating to allow the fluid to be supplied when the supply of electricity to the oil switching valve 63 is interrupted and thus to bring the intermediate lock mechanism 5 to the unlocked state, the ECU 7 for controlling the supply and the discharge of the fluid to the advanced angle chamber 41 and the supply and the discharge of the fluid to the retarded angle chamber 42, and the operation of the oil switching valve 63, wherein the supply of electricity to the oil switching valve 63 is interrupted after the pressure of the fluid which is received by the pressure-receiving surface 51*a* of the locking member 51 starts to decrease on the basis of the operation stop command of the engine 100 which is outputted from the ECU 7 in a case where the intermediate lock mechanism 5 is in the locked state.

According to the above-described configuration, the variable valve timing control apparatus 1 operates the oil pump 61 by means of the rotation of the crankshaft 101 of the engine 100 so as to supply the working fluid. Thus, the oil pump 61 supplies the working fluid during the time at which the rotation speed of the crankshaft 101 starts to decrease due to the ignition-off until the time at which the engine 100 stops operating, and thus the working fluid pressure is generated. However, because the supply of electricity to the oil switching valve 63 is continued at the time when the rotation speed of the crankshaft 101 starts to decrease, the working fluid is not supplied to the intermediate lock mechanism 5, and therefore the locked state remains established, that is, the locking member 51 remains engaged with the locking hole 52. After the rotation speed of the crankshaft 101 starts to decrease and thus the pressure of the working fluid which is received by the pressure-receiving surface 51*a* of the locking member 51 starts to decrease, the supply of electricity to the oil switching valve 63 is interrupted and the working fluid is supplied to the intermediate lock mechanism 5. The pressure of the working fluid supplied to the intermediate lock mechanism 5 works at the pressure-receiving surface 51*a*, however, this pressure is not high enough to release the locked state, and therefore the locked state is maintained. As a result, the relative rotational phase of the inner rotor 3 relative to the rotation of the housing 2 does not change from the time at which the rotation speed of the crankshaft 101 starts to decrease until the time at which the engine 100 stops operating, and therefore the engine 100 is started up at the optimal valve opening and closing timing of the intake/exhaust valve.

According to the embodiments, the supply of electricity to the oil switching valve 63 is interrupted in a case where the pressure of the fluid which is received by the pressure-receiving surface 51*a* of the locking member 51 is decreased relative to the locking member releasing threshold value P.

According to the above-described configuration, the supply of electricity to the oil switching valve 63 may be interrupted in a case where the pressure of the working fluid decreases to be lower than a threshold value of the fluid pressure which enables the locked state to be released, that is, the locking member releasing threshold value P, the intermediate lock mechanism 5 reliably maintains the locked state after the supply of electricity is interrupted. As a result, the relative rotational phase of the inner rotor 3 relative to the housing 2 does not change from the time at which the rotation speed of the crankshaft 101 starts to decrease until the time at which the engine 100 stops operating, and therefore the engine 100 is started up at the optimal valve opening and closing timing of the intake/exhaust valve.

According to the embodiments, the pressure of the fluid is detected by the fluid pressure sensor 64.

According to the above-described configuration, the pressure of the working fluid which is received by the pressure-receiving surface 51*a* of the respective locking member 51 may be detected directly and accurately. Thus, during the time at which the rotation speed of the crankshaft starts to decrease until the time at which the engine 100 stops operating, in a case where it is detected that the pressure of the working fluid comes to be below the threshold value of the fluid pressure which enables the locked state to be released, the supply of electricity to the oil switching valve 63 may be interrupted immediately. As a result, the supply of electricity may be interrupted in a short period of time, and thus the locked state may be reliably maintained with the minimum necessary supply of electricity. Accordingly, the engine 100 is started up at the optimal valve opening and closing timing of the intake/exhaust valve.

According to the embodiments, the pressure of the fluid is calculated on the basis of the rotation speed of the crankshaft 101 of the engine 100.

According to the embodiments, the pressure of the fluid is calculated on the basis of the temperature of the cooling medium flowing through the engine 100.

According to the above-described configuration, even in a case where the fluid pressure sensor 64 is not mounted on the vehicle, the crank angle sensor for detecting the rotation speed of the crankshaft 101 and the cooling medium temperature sensor measuring the temperature of the cooling medium that flows through the engine 100 are always provided at the vehicle. Thus, the range of the fluid pressure is indirectly obtained on the basis of the rotation speed of the crankshaft 101. The temperature range of the working fluid at that time is obtained indirectly on the basis of the temperature of the cooling medium which is detected by the cooling medium temperature sensor. As the negative correlation exists between the pressure of the working fluid and the temperature of the working fluid, the fluid pressure in the narrower range may be estimated from the rotation speed of the crankshaft 101 and the temperature of the cooling medium. Accordingly, in a case where the estimated fluid pressure comes to be below the threshold value of the fluid pressure which enables the locked state to be released during the period from the time at which the rotation speed of the crankshaft 101 starts to decrease until the time at which the engine 100 stops operating, the supply of electricity to the oil switching valve 63 may be interrupted. Consequently, the intermediate lock mechanism 5 reliably maintains the locked state even after the supply of electricity is interrupted, and thus the engine 100 is started up at the optimal valve opening and closing timing of the intake/exhaust valve.

According to the embodiments, the pressure of the fluid is calculated on the basis of the time, for example, the sufficient period of time.

According to the above-described configuration, the supply of electricity to the oil switching valve 63 may be interrupted after the period of time has elapsed, that is, the period of time during which the fluid pressure received by the pressure-receiving surface 51*a* of the respective locking member 51 comes to be sufficiently below the fluid pressure that enables the locked state to be released. As a result, the intermediate lock mechanism 5 reliably maintains the locked state with the inexpensive configuration without the complicated control performed by each of the sensors, and therefore the engine 100 is started up at the optimal valve opening and closing timing of the intake/exhaust valve.

According to the embodiments, the operation stop command is outputted when it is judged that the intermediate lock mechanism 5 is in the locked state.

According to the above-described configuration, the intermediate lock mechanism 5 reliably maintains the locked state.

The principles, preferred embodiments and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A variable valve timing control apparatus, comprising:

a driving side rotating member rotating synchronously with a crankshaft of an internal combustion engine;

a driven side rotating member rotating synchronously with a cam shaft for valve openings and closures of the internal combustion engine;

a fluid pressure chamber formed by the driving side rotating member and the driven side rotating member;

an advanced angle chamber and a retarded angle chamber which are formed by a partition portion provided at at least one of the driving side rotating member and the driven side rotating member and partitioning the fluid pressure chamber;

an intermediate lock mechanism including a locking member which is accommodated in one of the driving side rotating member and the driven side rotating member and is configured to protrude and retract relative to the other one of the driving side rotating member and the driven side rotating member, the intermediate lock mechanism including a locking hole formed at the other one of the driving side rotating member and the driven side rotating member in a manner that the locking hole is engaged with the locking member when the locking member comes to protrude, the intermediate lock mechanism being configured to switch between a locked state and an unlocked state, a relative rotational phase of the driven side rotating member relative to the driving side rotating member being restrained at an intermediate phase between a most retarded angle phase and a most advanced angle phase in the locked state when the locking member comes to protrude and engages with the locking hole, the restraint being released in the unlocked state as the locking member retracts from the locking hole;

a valve operating to allow a fluid to be discharged when electricity is supplied to the valve and thus to bring the intermediate lock mechanism to the locked state, the valve operating to allow the fluid to be supplied when supply of electricity to the valve is interrupted and thus to bring the intermediate lock mechanism to the unlocked state; and a control portion for controlling supply and discharge of the fluid to the advanced angle chamber and supply and discharge of the fluid to the retarded angle chamber, and an operation of the valve, wherein the supply of the electricity to the valve is interrupted after a pressure of the fluid which is received by a pressure-receiving surface of the locking member starts to decrease on the basis of an operation stop command of the internal combustion engine which is outputted from the control portion in a case where the intermediate lock mechanism is in the locked state, and the supply of the electricity to the valve is interrupted in a case where the pressure of the fluid which is received by the pressure-receiving surface of the locking member is decreased relative to a predetermined pressure.

2. The variable valve timing control apparatus according to claim 1, wherein the pressure of the fluid is detected by a fluid pressure sensor.

3. The variable valve timing control apparatus according to claim 1, wherein the pressure of the fluid is calculated on the basis of a rotation speed of the crankshaft of the internal combustion engine.

4. The variable valve timing control apparatus according to claim 1, wherein the pressure of the fluid is calculated on the basis of a temperature of a cooling medium flowing through the internal combustion engine.

5. The variable valve timing control apparatus according to claim 1, wherein the pressure of the fluid is calculated on the basis of a period of time.

6. The variable valve timing control apparatus according to claim 1, wherein the operation stop command is outputted when it is judged that the intermediate lock mechanism is in the locked state.

* * * * *